United States Patent [19]

Weisbeck

[11] 4,141,264

[45] Feb. 27, 1979

[54] ADJUSTABLE HIGH SPEED PUNCH

[75] Inventor: Ralph L. Weisbeck, Williamsville, N.Y.

[73] Assignee: Unipunch Products, Inc., Buffalo, N.Y.

[21] Appl. No.: 802,820

[22] Filed: Jun. 2, 1977

[51] Int. Cl.[2] ..... B26F 1/14

[52] U.S. Cl. ..... 83/23; 83/55; 83/140; 83/700

[58] Field of Search ..... 83/140, 143, 698, 700, 83/23, 55

[56] References Cited

U.S. PATENT DOCUMENTS

| | | | |
|---|---|---|---|
| 2,355,344 | 8/1944 | Wales | 83/700 X |
| 3,641,860 | 2/1972 | Whistler, Sr. et al. | 83/700 X |
| 3,958,476 | 5/1976 | Bartha | 83/143 |
| 4,007,653 | 2/1977 | Cady | 83/140 |
| 4,031,787 | 6/1977 | Cady | 83/140 |

*Primary Examiner*—Frank T. Yost
*Attorney, Agent, or Firm*—Joseph P. Gastel

[57] ABSTRACT

A punch assembly including a punch member having first and second ends, a punching end on the first end of the punch member, an adjustable head on the second end of the punch member, a shoulder on the punch member intermediate the first and second ends, a punch retainer member including a shoulder engaging portion adjacent the shoulder for effectively engaging the shoulder, a stripper spring between the punch retainer member and the adjustable head, retainer shims between the shoulder engaging portion and the shoulder, and a counterbore in the punch retainer member for receiving the retainer shims, the counterbore being of a diameter which is substantially the same as the outer diameter of the retainer shims. By the use of the retainer shims, the distance between a reference point on the retainer member and the end of the punch may be maintained the same even after sharpening, with the adjustable head being adjustable to maintain the overall length of the punch assembly the same after sharpening. The retainer shims are installed without requiring disassembly of the punch assembly by merely driving the retainer shims over the punching end of the punch assembly until they seat on a reduced central portion proximate the shoulder.

13 Claims, 10 Drawing Figures

ADJUSTABLE HIGH SPEED PUNCH

BACKGROUND OF THE INVENTION

The present invention relates to an improved punch assembly for use especially with high speed punching machines and a related method for prolonging the useful life of the punch assembly.

By way of background, in high speed turret punching machines, it is necessary to maintain the top of the punch assembly as close to the ram as possible. In addition, it is a matter of good practice to maintain the extreme bottom end of the punch member as flush with the bottom of the punch guide as possible. However, after a period of use, the punch member is sharpened by grinding the end thereof. This causes the sharpened end to lose its flush relationship with the end of the punch guide, thereby requiring a longer punching stroke of the machine with the attendant loss of time, considering that modern turret punching machines operate at the rate of approximately 200 strokes per minute. In addition, there is the added disadvantage that the longer stroke causes greater compression of the stripper spring, which in turn shortens its life because of the greater amount of flexing to which it is subjected.

In the past the foregoing problem was solved after a fashion by the use of a reversible split ring punch retainer member having a lip on one side thereof. The split ring punch retainer member is essentially located between the stripper spring and a fixed shoulder on the punch member. When the punch is new, that is before it has been sharpened, the side of the split ring punch retainer which does not have the lip bears against the shoulder on the punch member, and the lip is received in an enlarged bore in the split ring punch retainer. After the punch has been sharpened, the split ring punch retainer is demounted from the punch and is reversed so that the lip takes up the distance which has been taken off of the punch member by sharpening. However, this construction is deficient in that it requires disassembly of the punch assembly in order to bring the lip into operative position, and this is a rather inefficient and cumbersome procedure. In addition, the lip is very fragile and cannot take sustained punching activity. It is with overcoming the foregoing deficiencies of the prior punching assemblies that the present invention is concerned.

SUMMARY OF THE INVENTION

In accordance with one aspect of the present invention, a construction is provided for compensating for shortening of the punch member of a punch assembly as a result of sharpening by installing retainer shims onto the punch member and adjusting the head thereof to maintain the various portions at the proper desired length, the installation of the retainer shims being effected conveniently without disassembly of the punch assembly.

In accordance with another aspect of the present invention, a punch assembly is provided for use with a high speed punching machine, which assembly not only permits the punch to be sharpened an extremely great number of times to prolong the life of the punch but also obviates the necessity for lengthening the stroke of the punch after sharpening, thereby also prolonging the life of the stripper spring.

The present invention relates to a punch assembly for providing a total overall length between the top of a head and the extreme end portion of the punching portion of the punch member irrespective of the actual length of the punch member while maintaining a fixed distance between a predetermined reference point and the top of said head comprising a punch member having first and second ends and a central portion therebetween, a punching portion including an extreme end portion at said first end, an adjustable head mounted on said second end, a shoulder on said central portion facing away from said first end, punch retainer means for effective engagement with said shoulder, stripper means effectively located between said adjustable head and said punch retainer means, a reference point bearing a fixed relationship to said retainer means, a punch guide at said first end of said punch member and extending toward said central portion, and retainer shim means separate from said punch retainer means and insertable between said punch retainer means and said shoulder after said extreme end portion has been sharpened to thereby cause the distance between said extreme end portion and said reference point to remain the same as before said extreme end portion was sharpened, said adjustable head being adjustable relative to said second end to maintain the distance between said adjustable head and said reference point the same as before said extreme end portion was sharpened.

The present invention also relates to a method of maintaining the same overall length of the punch assembly between the top of a head and the extreme end portion of the punching portion of the punch member irrespective of the actual length of the punch member while maintaining a fixed distance between a predetermined reference point and the top of said head, comprising the steps of providing a punch member having first and second ends and a central portion therebetween, providing a punching portion including an extreme end portion at said first end, mounting an adjustable head on said second end, providing a shoulder on said central portion with said shoulder facing away from said first end, mounting punch retainer means on a portion of reduced diameter on said central portion with said punch retainer means being in effective engagement with said shoulder, mounting stripper means between said adjustable head and said punch retainer means, providing a fixed reference point relative to said retainer means, mounting retainer shim means between said shoulder and said retainer means for compensating for the sharpening of said extreme end of said punch member, said retainer shim means being mounted by moving said retainer shim means over said first end and along said punch member until said retainer shim means settles onto said portion of reduced diameter, whereby the distance between said extreme end and said reference point will be the same after said extreme end was sharpened as it was before it was sharpened, and adjusting the position of said adjustable head on said punch member so as to cause the distance between the top of said head and said fixed reference point to be the same after said extreme end was sharpened as it was before said extreme end was sharpened.

The various aspects of the present invention will be more fully understood when the following portions of the specification are read in conjunction with the accompanying drawings wherein:

DESCRIPTION OF THE PREFERRED EMBODIMENTS

Figures 1, 2, 3, 4, 5:
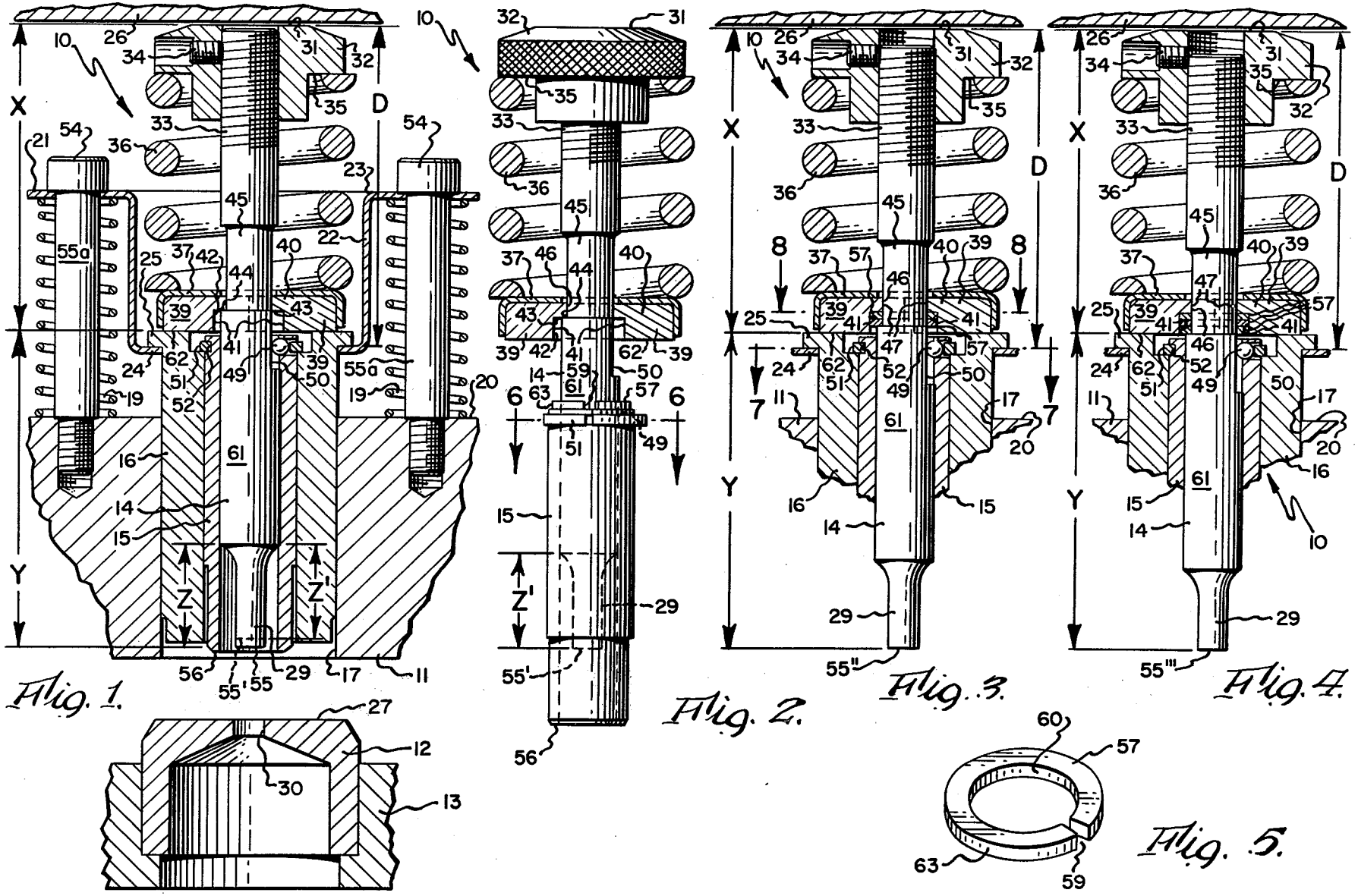
FIG. 1 is a fragmentary cross sectional view of the improved high speed punch assembly of the present invention mounted on the turret of a turret type punching machine.
FIG. 2 is a side elevational view showing the manner in which a retainer shim is being installed on the punch member after the end thereof has been sharpened.
FIG. 3 is a fragmentary cross sectional view similar to FIG. 1 but showing two retainer shims mounted on the punch member after the end thereof has been sharpened a corresponding amount.
FIG. 4 is a fragmentary cross sectional view similar to FIG. 3 but showing three retainer shims mounted on a punch member after the punch member has been sharpened a corresponding amount.
FIG. 5 is a perspective view of the retainer shim.
Figure 8:
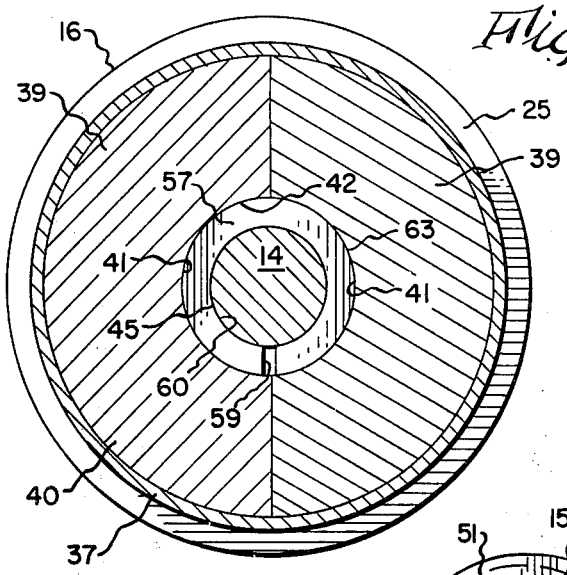
FIG. 8 is a cross sectional view taken substantially along line 8—8 of FIG. 3 and showing the assembled relationship between the punch member, retainer shim, split ring punch retainer, and spring retaining spacer.
Figure 7:
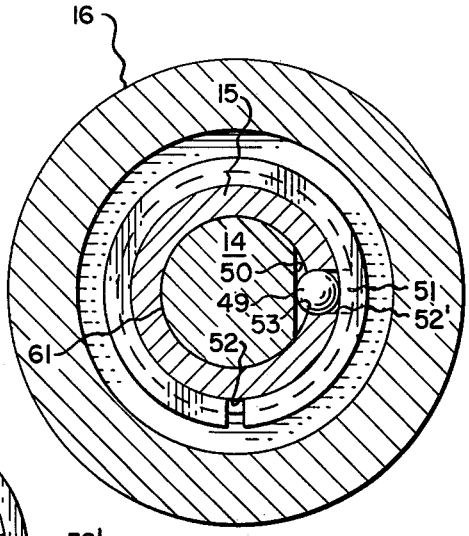
FIG. 7 is a cross sectional view taken substantially along line 7—7 of FIG. 3 and showing the ball detent in holding position against a flat portion of the punch member.
Figure 6:
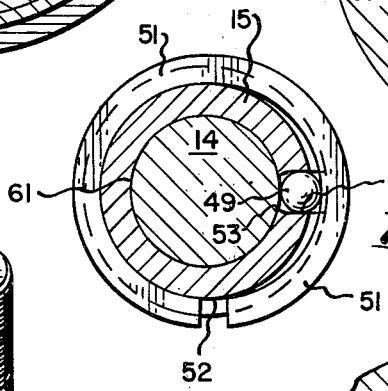
FIG. 6 is a cross sectional view taken substantially along line 6—6 of FIG. 2 and showing the manner in which the ball detent is mounted on the punch guide.

The improved punch assembly 10 of the present invention is shown in FIG. 1 mounted on the upper turret guide holder 11 of a turret type punching machine. The die 12 is mounted in opposition to the punch assembly 10 on bottom turret die holder 13 of the turret-type punching machine.

In FIG. 1 a punch member 14 is shown before the end portion 55 has been sharpened at all. Punch member 14 is slidably mounted in annular punch guide 15 which is received in annular adapter 16 which in turn is mounted for linear sliding movement in bore 17 of bottom turret die holder 11. A pair of lifter springs 19 have their lower ends bearing against the upper surface 20 of upper turret guide holder 11 and their upper ends bearing against the underside of annular flange 21 of annular body 22 of lifter bracket 23 which also has an annular flange 24 bearing against the underside of annular collar 25 which is formed integrally with adapter 16. Thus, lifter springs 19 will return the punch assembly 10 to the position shown in FIG. 1 when it is not being held in a downward position by ram 26.

Figure 9:
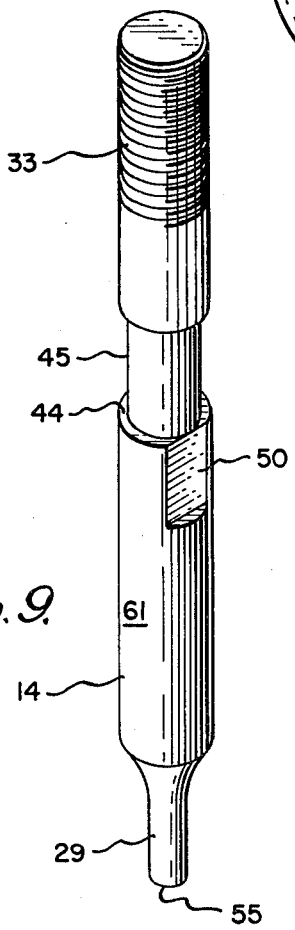
FIG. 9 is a perspective view of the punch member.

During a punching operation, a workpiece is positioned on the upper surface 27 of die 12 and ram 26 is actuated to drive the end portion 29 of punch 14 through the workpiece and through hole 30 in die 12. During the punching operation, the ram 26 engages the upper surface 31 of adjustable head 32, which is threadably mounted on the threaded end portion 33 of punch member 14 and is retained in position thereon by set screw 34. The annular undersurface 35 of adjustable head 32 bears against the upper end of stripper spring 36, the lower end of which bears against the upper surface of inverted cup 37 which contains the two generally semicylindrical halves 39 which in combination comprise a split ring punch retainer 40. Each of the split punch retainer members 39 include a semicylindrical surface 41 which jointly form a counterbore 42, the end surface 43 of which bears against upwardly facing shoulder 44 (FIG. 9) of punch 14. Shoulder 44 is formed adjacent to the reduced cylindrical portion 45 of the punch body which is received between the cylindrical surface 46 (FIG. 3) formed by the two semicylindrical surfaces 47 of the split ring punch retainer 40.

The punch guide 15 is retained in position on punch member 14 by virtue of the fact that a ball detent 49 is pressed against flat surface 50 by circular spring member 51 which is received in an annular groove 52 on the outside of punch guide 15. Ball 49 is located in cylindrical bore 52' in punch guide 15 and is retained against falling out by virtue of the fact that the end of bore 52' is peened at 53.

In operation ram 26 will descend to drive punch 14 toward die 12 against the bias of stripper spring 36 and lifter springs 19. After ram 26 has driven the lower end 29 through the workpiece to the desired extent, ram 26 will move upwardly and stripper spring 36 will expand to pull the lower end 29 of the punch out of the workpiece. After lower end 29 is free from the workpiece, the lifter springs 19 will expand to return the punch assembly 10 to the position shown in FIG. 1. The upper limit of movement of punch assembly 10 is realized when annular flange 21 engages the undersides of heads 54 of screw members **55*a* which are mounted on the upper turret guide holder 11. At this point it is to be especially noted that when stripper spring 36 expands, it will tend to move adjustable head 32 away from punch retainer 40 and its confining cup 37. Since retainer 40 and cup 37 can slide on reduced portion 45, the limit of movement of retainer 40 will be realized when end surface 43 of the counterbore 42 abuts shoulder 44** on the punch member.

It will be appreciated that after punch member 14 has been used for a predetermined number of strokes, the end portion 55 will become dull. This necessitates removing the subassembly of the punch member 14, guide 15, retainers 39, cup 37, stripper spring 36 and adjustable head 32 from the remainder of the unit. Thereafter, guide 15 is removed and end 55 is sharpened on a suitable tool, usually a grinder, and in this process between approximately 1/16 and ⅛ inch is removed from the end 55 to produce a new end 55' (FIG. 2). In other words, the distance Z of FIG. 1 is approximately between 1/16 and ⅛ inch longer than the distance Z' of FIG. 2, after the end portion 29 has been sharpened.

If the punch assembly 10, after sharpening, were to be remounted as shown in FIG. 1, without an adjustment, the lower end 55' of the punch member 14 would be positioned at a higher elevation, as shown by Z' in FIG. 1. This would be objectionable because the turret punch operates at an extremely high speed, approximately 200 strokes per minute, so that it is necessary that the lower end, such as 55 or 55' of the punch, be as flush as possible with the lower end 56 of the punch guide. If the lower end 55 is too far up into the punch guide, it takes too long to come down and therefore will not permit the machine to operate at maximum speed. In addition, it will be noted that if the bottom end, such as 55', of the punch, is too far up into the punch guide, the stroke of ram 26 has to be lengthened in order to cause the punch end 29 to penetrate the same amount of the workpiece, after the end 29 has been sharpened. This is undesirable because it causes excessive flexing of stripper spring 36 and at high speeds such extra flexing shortens the life of the stripper spring. Therefore, it is necessary to maintain the bottom end 55' of the punch member 14 as flush as possible to the lower end 56 of punch guide 15, after the punch 14 has been sharpened.

In accordance with the present invention, the punch end 55 or 55' is maintained substantially flush with the end 56 of the punch guide in an unique manner. In this respect, spring steel substantially annular split retainer shims 57 (FIG. 5) are provided. Retainer shim 57 includes a split or gap 59 which permits it to expand beyond its normal relaxed position shown in FIG. 5. In its relaxed position its inner diameter 60 is slightly less than the outer diameter of reduced portion 45 of punch member 14 so that it will engage this reduced portion with an interference fit. Retainer shim 57 has a thickness of approximately 1/16 of an inch.

Assuming that the difference in length between Z and Z' is approximately 1/16 of an inch, all that is necessary to return the bottom 55' of the punch end 29 substantially flush with the bottom 56 of the punch guide 15 is to drive retainer shim 57 onto reduced portion 45. This is accomplished by slipping retainer shim 57 over the end 29 of the punch after punch guide 15 has been removed, and thereafter using punch guide 15 as a driving tool (FIG. 2) to drive retainer shim 15 over portion 61 of punch member 14 until retainer shim 57 passes over shoulder 44 and becomes seated on reduced portion 45. While the shim travels over portion 61, it expands. A special driving tool can be used instead of guide 15. Such a tool would be required when the diameter of portion 29 was equal to the diameter of portion 61 and the driving tool had to have a counterbore to hold shim 57 in proper orientation for installation on the end of the punch 14. It is to be especially noted that retainer shim 57 can be installed without disassembling parts 39, 37, 36 and 32 from the punch member 14. At this point it is to be noted that the thickness of shims which are to be added can be gauged by mounting guide 15 on punch 14 and moving it up into contact with surface 62 to determine how many shims must be added to cause surface 56 to be flush with the end of the tool.

Assuming that the end 29 of punch member 14 was ground down only about 1/16 of an inch, and considering that retainer shim 57 is 1/16 of an inch thick, the distance between undersurface 62 of the split retainers 39 and the end 55 in FIG. 1, before grinding, will be the same as the distance between the undersurface 62 and the end 55', after grinding, because of the existence of the shim. The maintaining of this relationship is represented by distance Y in FIGS. 1, 3 and 4. In this respect, it is to be noted that FIG. 3 shows two retainer shims 57 mounted on punch member 14 to compensate for grinding the end 29 to surface 55'', that is, taking off $\frac{1}{8}$ inch from the end. In FIG. 4 there are three shims 57 to compensate for reducing the end of punch 29 to surface 55''', that is, grinding off 3/16 of an inch. By virtue of installing the retainer shims 57 in the above-described manner, the relationship between the extreme lower end of the punch and the extreme end 56 of the punch guide, as shown in FIG. 1, is maintained, notwithstanding that the end 29 of the punch member has been shortened.

However, when the shims are placed in the positions shown in FIGS. 3 and 4, the adjustable head 32 is drawn downwardly an amount corresponding to the thickness of retainer shims which have been installed. It is undesirable that the ram 26 should have to travel more than is necessary before engaging the top 31 of adjustable head 32. In other words, it is desirable that there be as little clearance as possible between the underside of ram 26 and the top 31 of adjustable head 32, as shown in FIG. 1. Therefore, in order to compensate for the fact that punch member 14 has been moved bodily downward by mounting of shims 57 thereon, it is merely necessary to loosen set screw 34 and turn adjustable head 32 on punch member 14 so that the distance X is maintained at all times in FIGS. 1, 3 and 4, regardless of the number of shims which have been mounted on punch member 14. In other words, the total distance X plus Y must always remain the same even though the end 29 of punch member 14 has been shortened, and this has been accomplished by applying shims to the punch member 14 to move the lower end thereof downwardly after it has been ground and compensating for this by moving the adjustable head 32 upwardly so as to lengthen the upper end of punch member 14.

At this point it is to be noted that the reference point which has been used for distance X is the distance from the underside 62 of split retainer 40 to the top 31 of adjustable head 32, as this dimension is the one which is required to permit the top of punching unit 10 to move under ram 26 with a minimum of clearance. However, it will be appreciated that any other reference point can be used. In practice the reference point which is used is from the underside of annular collar 25 to the top 31 of head 32, and this is represented by distance D. In this respect, after the shim or shims have been mounted to cause the end, such as 55' of the tool, to be substantially flush with the end 56 of the guide, all that is necessary is to adjust head 32 until distance D is obtained.

At this point it is to be especially noted that the outer diameter 63 of the retainer shims 57 is only slightly smaller than the diameter of the counterbore 42 so that the retainer shims 57 fit snugly within counterbore 42. This relationship insures that the retainer shims will not expand when the ram is moving the punch downwardly through the workpiece, and thus it is assured that the retainer shims 57 will not slip over shoulder 44 during the downward stroke of the ram.

In addition, it is to be especially noted that the end 29 of the punch can be sharpened as many times as is desired as long as additional retainer shims 57 can be mounted in the above-described manner and as long as the adjustable head 32 can be moved upwardly to compensate for the additional shims which have been installed. This permits the same punch member 14 to be used from three to five times longer than a conventional punch which cannot be shimmed in the above-described manner. In addition, it is to be noted that every time a new shim, such as 57, is added, this shim is the one which will bear against shoulder 44 of the punch member 14 and thus it will provide a new wear surface for engagement with shoulder 44.

It can thus be seen that the foregoing described arrangement for prolonging punch life has the advantages that the shims can be mounted without complete disassembly of the punch member 14 from its related structure and the shims will automatically lock in place on reduced portion 45. In addition, the desired overall punch length is maintained, as is the relationship between the bottom of the punch and the bottom of the punch guide. This permits sharpening of the punch an extremely large number of times to thereby prolong the life of the punch, while obviating the necessity for lengthening the stroke of the ram after sharpening, thereby prolonging the life of the stipper spring.

Figure 10:
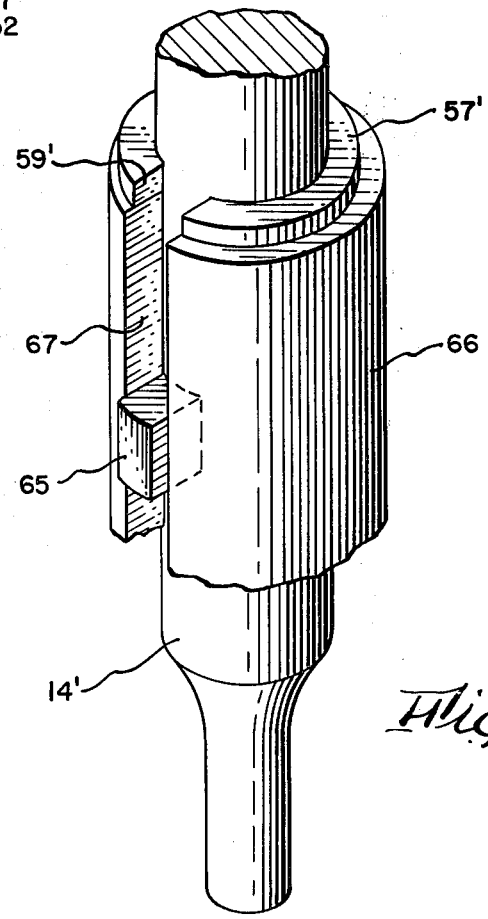
FIG. 10 is a fragmentary perspective view of a modified type of punch member having a key therein with a retainer shim having a larger opening which can move past the key during installation.

In FIG. 10 a modified form of retainer shim 57' is shown for use with a punch member 14' having a key 65 therein which cooperates with a punch guide 66 having a slot 67 to receive key 65. Retainer shim 57' includes a slot 59' which is wider than key 65 so that when shim 57' is mounted on punch member 14', it can pass key 65. Aside from the fact that slot 59' is larger than slot 59 and aside from the fact that key 65 is mounted on punch 14', the remainder of the structure of punch 14' is identical to punch 14 of FIG. 1.

It will be appreciated that a split ring retainer 39—39 must be used because a full unsplit retainer cannot be mounted on reduced portion 45 because the latter is between two portions, 33 and 61, of greater diameter. However, if the threaded portion 33 were of the same or smaller diameter than portion 45, an unsplit retainer could be mounted on reduced portion 45 by slipping it downwardly over portion 33.

While the foregoing description has referred to a stripper spring, it will be understood that the present invention can also be used with punch assemblies having other types of stripper means, such as urethane, rubber or dished discs.

While preferred embodiments of the present invention have been disclosed, it will be appreciated that the present invention is not limited thereto but may be otherwise embodied within the scope of the following claims.

What is claimed is:

1. A punch assembly comprising a punch member having first and second ends, a punching end on said first end of said punch member, an adjustable head on said second end of said punch member, a shoulder on said punch member intermediate said first and second ends and facing said second end, a punch retainer member including a shoulder engaging portion adjacent said shoulder for effectively engaging said shoulder, stripper means between said punch retainer member and said adjustable head, retainer shim means separate from said punch retainer member insertable between said shoulder engaging portion and said shoulder to compensate for sharpening of said punching end, and a counterbore in said punch retainer member for receving said retainer shim means.

2. A punch assembly as set forth in claim 1 wherein said retainer shim means comprises an annular split spring member.

3. A punch assembly as set forth in claim 2 wherein said counterbore is of a diameter which is slightly larger than the outer diameter of said retainer shim means.

4. A punch assembly as set forth in claim 1 wherein said retainer shim means comprises a plurality of annular split spring members.

5. A punch assembly for providing a total overall length between the top of a head and the extreme end portion of the punching portion of the punch member irrespective of the actual length of the punch member while maintaining a fixed distance between a predetermined reference point and the top of said head comprising a punch member having first and second ends and a central portion therebetween, a punching portion including an extreme end portion at said first end, an adjustable head mounted on said second end, a shoulder on said central portion facing away from said first end, punch retainer means for effective engagement with said shoulder, stripper means effectively located between said adjustable head and said punch retainer means, a reference point bearing a fixed relationship to said retainer means, a punch guide at said first end of said punch member and extending toward said central portion, and retainer shim means separate from said retainer means and insertable between said punch retainer means and said shoulder after said extreme end portion has been sharpened to thereby cause the distance between said extreme end portion and said reference point to remain substantially the same as before said extreme end portion was sharpened, said adjustable head being adjustable relative to said second end to maintain the distance between said adjustable head and said reference point the same as before said extreme end portion was sharpened, said central portion including a portion of reduced diameter between said shoulder and said second end, and said retainer shim means comprising a substantially annular split spring member which is mountable on said punch member by driving it over said first end portion until it settles onto said portion of reduced diameter proximate said shoulder.

6. A punch assembly as set forth in claim 5 wherein said retainer shim means comprises a plurality of annular split spring members.

7. A punch assembly as set forth in claim 5 including a counterbore in said punch retainer means for receiving said retainer shim means.

8. A method of maintaining the same overall length of a punch assembly between the top of a head and the extreme end portion of the punching portion of the punch member irrespective of the actual length of the punch member, while maintaining a fixed distance between a predetermined reference point and the top of said head comprising the steps of providing a punch member having first and second ends and a central portion therebetween, providing a punching portion including an extreme end portion at said first end, mounting an adjustable head on said second end, providing a shoulder on said central portion with said shoulder facing away from said first end, mounting punch retainer means on a portion of reduced diameter on said central portion with said punch retainer means being in effective engagement with said shoulder, mounting stripper means between said adjustable head and said punch retainer means, providing a fixed reference point relative to said punch retainer means, mounting retainer shim means between said shoulder and said retainer means for compensating for the sharpening of said extreme end of said punch member, said retainer shim means being mounted by moving said retainer shim means over said first end and along said punch member until said retainer shim means settles onto said portion of reduced diameter whereby the distance between said extreme end and said reference point will be the same after said extreme end was sharpened as it was before it was sharpened, and adjusting the position of said adjustable head on said punch member so as to cause the distance between the top of said head and said fixed reference point to be the same after said extreme end was sharpened as it was before said extreme end was sharpened.

9. A method as set forth in claim 8 wherein said retainer shim means comprises an expandible substantially annular split spring member which will expand when it is moved over said first end portion and will snap onto said reduced portion.

10. A method as set forth in claim 8 wherein said step of mounting retainer shim means comprises the mounting of a plurality of retainer shim means on said punching member.

11. A method as set forth in claim 10 wherein said retainer shim means comprises an expandible substantially annular split spring member which will expand when it is moved over said first end portion and will snap onto said reduced portion.

12. A method as set forth in claim 8 wherein said steps of mounting retainer shim means and adjusting said adjustable head are performed each time said extreme end is sharpened.

13. A method as set forth in claim 12 wherein said retainer shim means comprises an expandible substantially annular split spring member which will expand when it is moved over said first end portion and will snap onto said reduced portion.

* * * * *